US006044560A

United States Patent [19]

Chao

[11] Patent Number: 6,044,560

[45] Date of Patent: Apr. 4, 2000

[54] KNIFE

[76] Inventor: Chien-Chuan Chao, No. 13, Lane 15, Sec. 2, Fuhsing Rd., S. Dist, Taichung, Taiwan

[21] Appl. No.: 09/176,908

[22] Filed: Oct. 22, 1998

[51] Int. Cl.[7] ..... B26B 1/08

[52] U.S. Cl. ..... 30/123; 30/162

[58] Field of Search ..... 30/162, 123; 7/123; 83/520

[56] References Cited

U.S. PATENT DOCUMENTS

| | | | |
|---|---|---|---|
| 3,831,276 | 8/1974 | Dalton et al. | 30/123 |
| 4,835,865 | 6/1989 | Knoop | 30/162 |
| 5,313,376 | 5/1994 | McIntosh | 362/119 |
| 5,315,760 | 5/1994 | Emerson | 30/123 |
| 5,402,575 | 4/1995 | Maxcy | 30/123 |
| 5,513,405 | 5/1996 | Bradbury, Jr. et al. | 30/123 |
| 5,581,890 | 12/1996 | Schmidt | 30/162 |
| 5,813,121 | 9/1998 | Gringer | 30/162 |
| 5,862,596 | 1/1999 | Chung | 30/162 |

*Primary Examiner*—Rinaldi I. Rada
*Assistant Examiner*—Omar Flores Sánchez
*Attorney, Agent, or Firm*—Bacon & Thomas

[57] ABSTRACT

A knife is provided with a built-in battery box therein and a bulb mounted on the outlet of the blade. Batteries are received in the battery box and are selectively and electrically connected between the bulb and a button which is movably mounted on side of the knife, such that when the button is electrically engaged between the battery and the bulb, the bulb is lit so as to enable a user to work in a place with poor visibility.

1 Claim, 5 Drawing Sheets

KNIFE

BACKGROUND OF THE INVENTION

1. Field of the Invention

The present invention relates to an improved knife that has a bulb mounted therein to make use of the knife more convenient.

2. Description of Related Art

A knife is usually used in various fields. However, sometimes the light at the work site is poor, which causes the cutting operation to be difficult.

SUMMARY OF THE INVENTION

The main object of the present invention is to provide an improved knife integrally forming a built-in battery box with batteries received therein, wherein a bulb is mounted beside the junction of the blade and the handle, wires electrically connect the bulb and the batteries, and a switch is provided on the side of the knife body. Thus a user is able to operate the switch and light the area around the knife blade.

DETAILED DESCRIPTION OF PREFERRED EMBODIMENT

Figure 1:
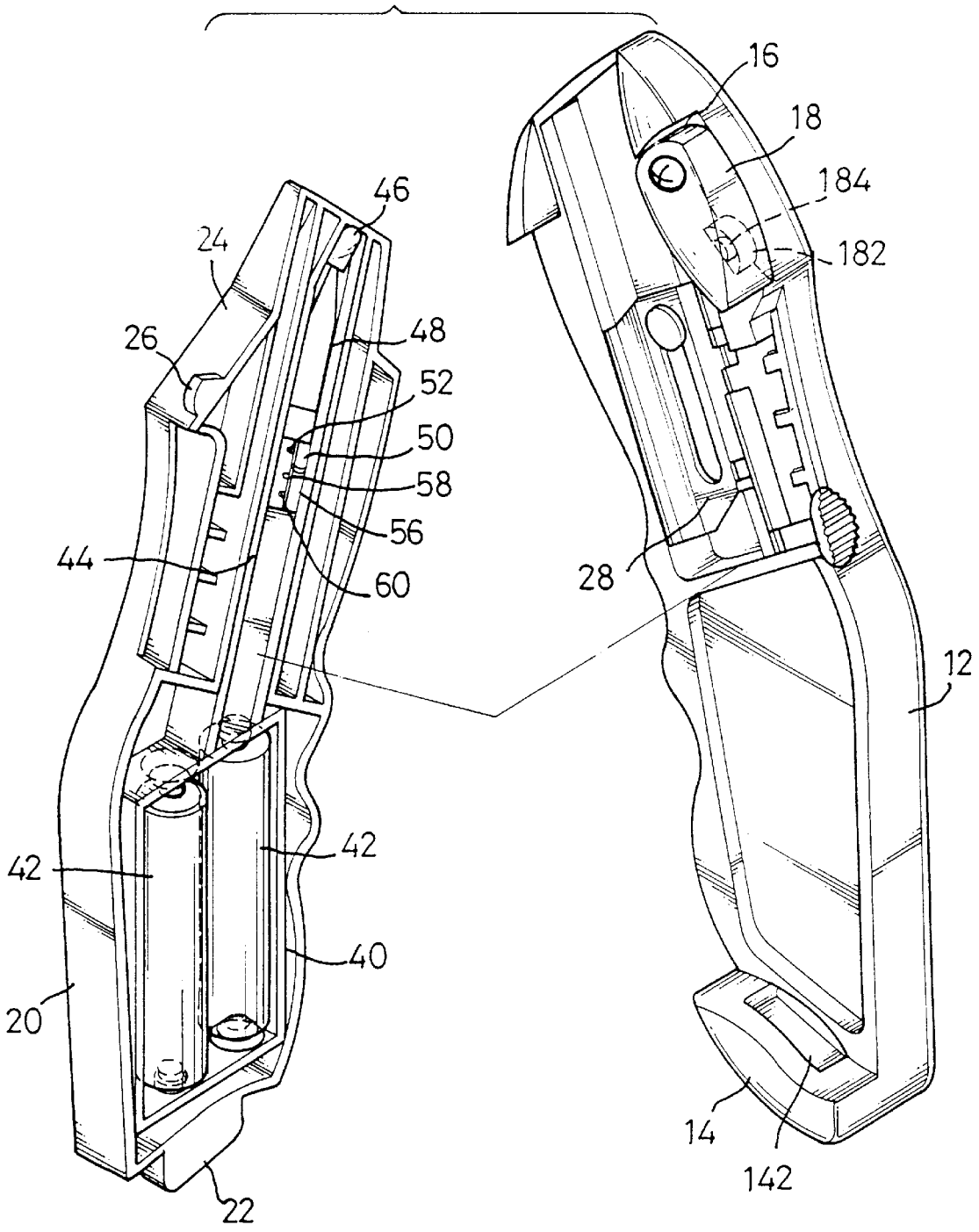
FIG. 1 is an exploded perspective view of the knife of the present invention.
Figure 4:
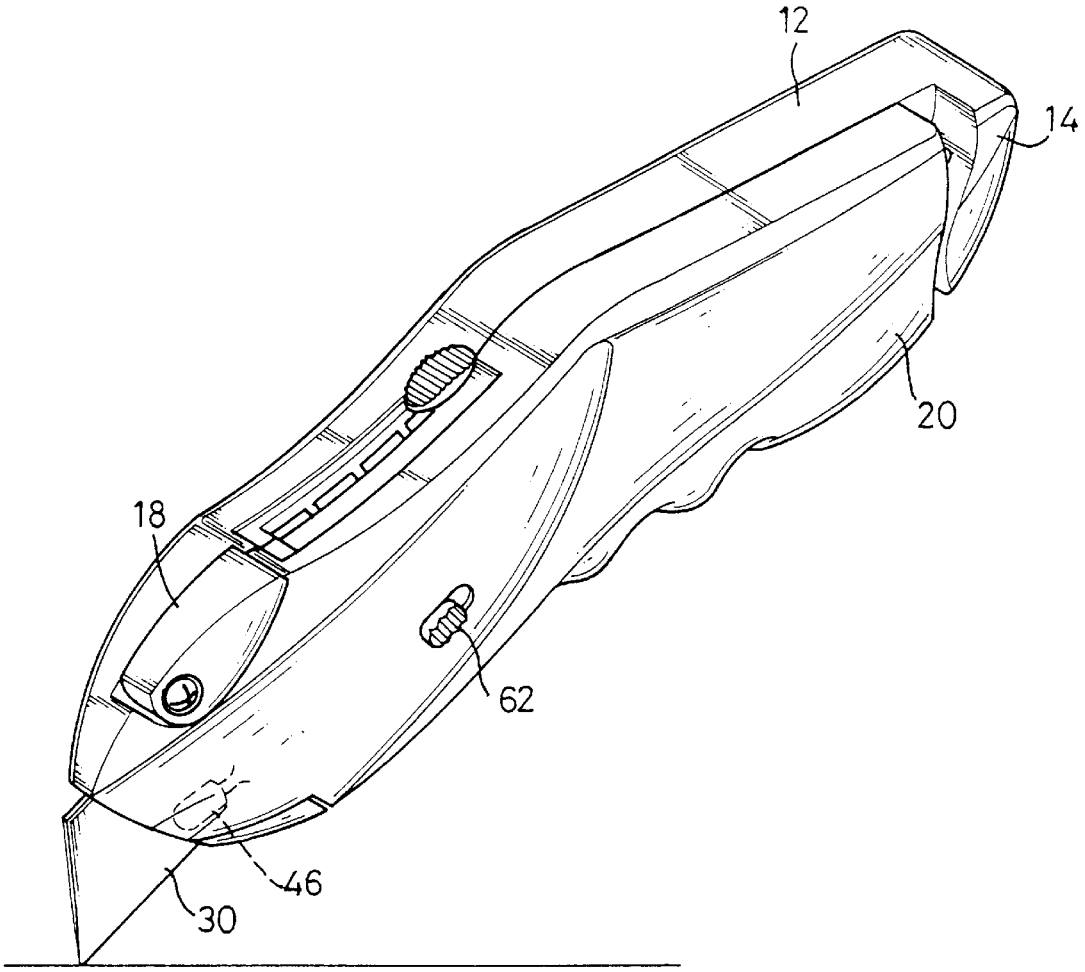
FIG. 4 is a perspective view of the present invention, showing the operation of the knife.
Figure 5:
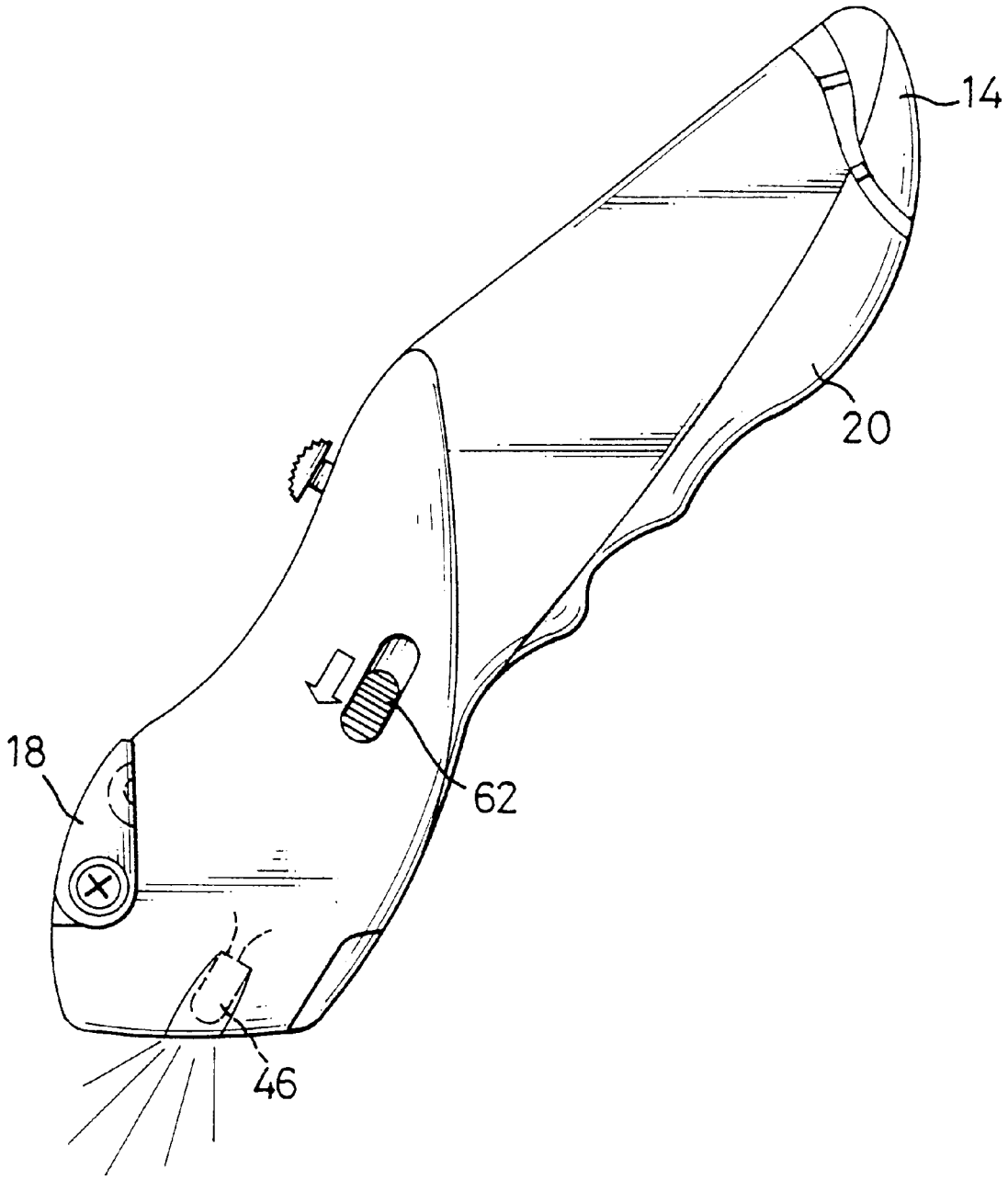
FIG. 5 is a side plan view of the present invention, showing the operation of the knife.

As shown in FIGS. 1 and 4, the present invention provides a knife including a body (12) and a cover (20) that joins with the body (12) to become a main body. A blade holder (28) is formed on the body (12) for holding a blade (30) thereon. The blade (30) is movably received in the main body.

A bulge member (14) is formed at the bottom end of the body (12) and defines a proximal L-shaped groove (142) therein. A projection (22) is formed on the bottom end of the cover (20) and corresponds to the groove (142), such that the cover (20) is able to connect with the body (12) by having the projection (22) received in the groove (142).

The body (12) defines a slot (16) on the side face near the top end thereof, and the cover (20) defines a counter-slot (24) corresponding to the slot (16) on the top end thereof. A fastening post (18) is pivotally received in the slot (16) and has a recess (182) defined in the side face thereof. The recess (182) is essentially half circle shaped, and has a pole (184) axially extending out therefrom. A fastener (26) corresponding and complementarily configured to the recess (182) is formed on the face of the counter-slot (24). When the cover (20) is assembled with the body (12), the fastener (26) is fittingly received in the recess (182).

Figure 2:
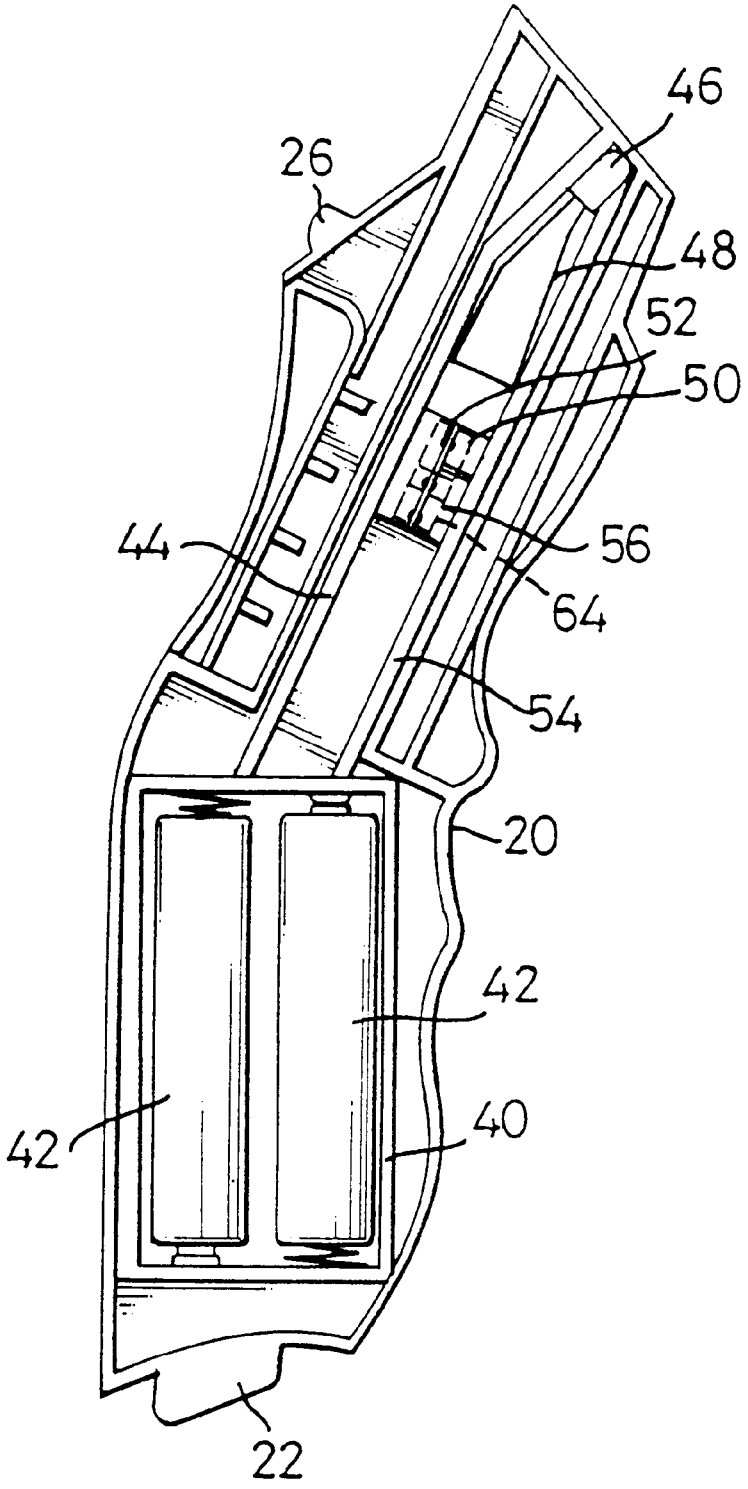
FIG. 2 is a plan view of the bottom of the cover of the knife of the present invention.
Figure 3:
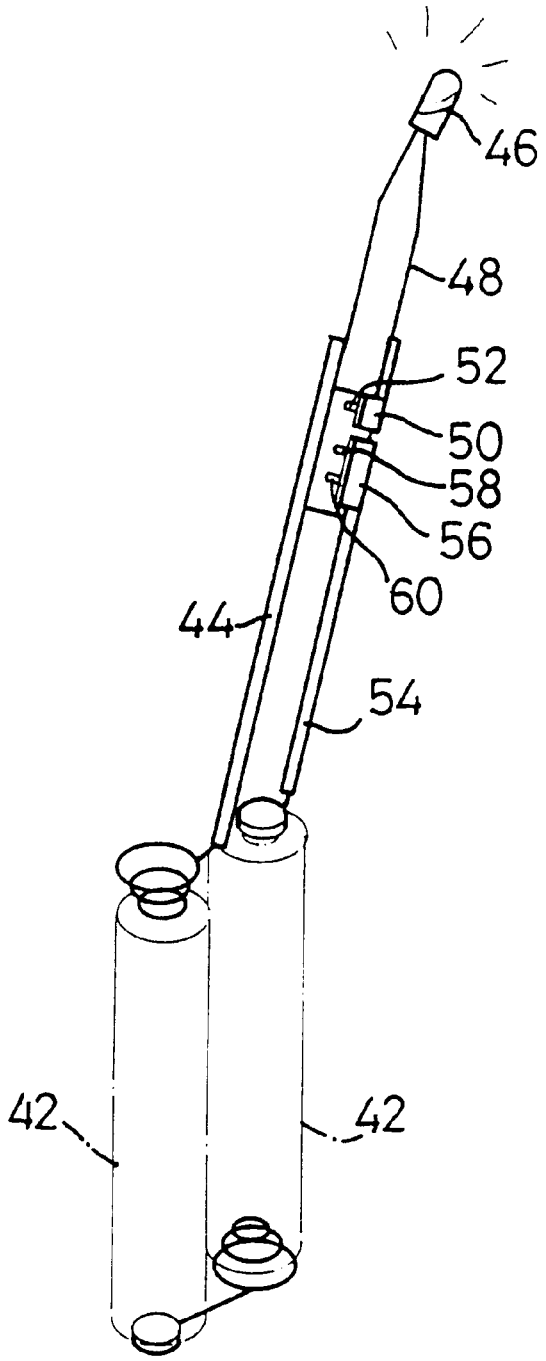
FIG. 3 is a perspective view showing the operation of the bulb in the knife of the present invention.

As illustrated in the FIGS. 2 and 3, the present invention is particularly characterized that the cover (20) integrally forms a battery box (40) with batteries (42) mounted therein. A bulb (46) is provided near the outlet of the blade. A first wire (44) electrically connects between the bulb (46) and one of the batteries (42). A second wire (48) electrically connects between the bulb (46) and a metal piece (50) having an electrical contact (52) formed thereon. Furthermore, a third wire (54) electrically connects the other battery (42) to a second metal piece (56) which has two contacts (58, 60) spaced apart and formed thereon. As shown in FIGS. 2–5, a button (62) with a conductive strip (64) provided therein is movably mounted on the side of the cover (20). When the switch (62) is pushed forward, the contacts (52, 58) are connected by the conducting strip (64), and the battery (42), the wires (44, 48, 54), the metal pieces (50, 56) and the bulb (46) form a complete electrical circuit. The bulb (46) is then lit, and the operation of the knife (10) will be more convenient especially in a place with poor visibility since illumination is provided by the light.

What is claimed is:

1. A knife comprising a body and a cover arranged to be joined together to form a main body for said knife, wherein a blade holder is mounted between the body and the cover with a blade held thereon; a bulge member is formed at a bottom end of the body and defines a groove therein; a projection is formed on a bottom end of the cover corresponding to the groove; a slot is defined in the side face near a top end of the body towards the cover; and a counter-slot is defined on the top end portion of the cover, wherein a fastening post is pivotally mounted in the slot, a recess is defined in the side face of the fastening post and has a pole axially extending therefrom, and a fastener member is formed on an edge of the counter-slot corresponding to the recess;

a built-in battery box having at least one battery received therein, said battery compartment being integrally formed in the cover at an end of the cover adjacent the bulge member;

a plurality of wires and at least two switch contacts;

a bulb positioned at an end of said cover adjacent an outlet of the blade and electrically connected to said at least one battery by said wires and said at least two switch contacts; and a button having a conducting strip therein is provided on the cover to control an electrical connection between the at least one battery and the bulb by selectively electrically connecting said at least two switch contacts to each other, said at least two switch contacts also being situated in said cover between said bulb and battery compartment situated at opposite ends of said cover, wherein when said button is moved to electrically connect said at least two contacts to each other, light from said bulb shine through the front end of said main body.

* * * * *